US005226611A

United States Patent [19]

Butterworth et al.

[11] Patent Number: 5,226,611

[45] Date of Patent: Jul. 13, 1993

[54] TWIN STATION REWINDER

[75] Inventors: Tad T. Butterworth; Warren A. Kehn, both of Ashland, Wis.

[73] Assignee: C. G. Bretting Manufacturing Co., Inc., Ashland, Wis.

[21] Appl. No.: 821,961

[22] Filed: Jan. 16, 1992

[51] Int. Cl.[5] ..... B65H 18/20

[52] U.S. Cl. ..... 242/56 R; 242/66

[58] Field of Search ..... 242/56 R, 65, 66

[56] References Cited

U.S. PATENT DOCUMENTS

| | | | |
|---|---|---|---|
| 3,030,042 | 4/1962 | DeGelleke | 242/56 R |
| 3,167,268 | 1/1965 | Birch et al. | 242/66 |
| 3,514,047 | 5/1970 | DeMallie et al. | 242/66 |
| 3,844,189 | 10/1974 | Jardine | 242/66 X |
| 3,869,095 | 3/1975 | Diltz | 242/67.1 R X |
| 3,972,486 | 8/1976 | Straujups | 242/66 |
| 4,000,863 | 1/1977 | Straujups | 242/66 X |
| 4,428,543 | 1/1984 | Kuhn | 242/66 |
| 4,508,279 | 4/1985 | Tokuno et al. | 242/56 R |
| 4,695,005 | 9/1987 | Gietman, Jr. | 242/56 R |
| 4,826,095 | 5/1989 | Wywialowski | 242/66 |
| 4,892,119 | 1/1990 | Hugo et al. | 242/66 X |
| 4,932,599 | 6/1990 | Doerfel | 242/66 X |
| 4,962,897 | 10/1990 | Bradley | 242/66 X |
| 4,988,051 | 1/1991 | Welschlau et al. | 242/56 R |
| 5,030,311 | 7/1991 | Michal et al. | 242/56 R X |
| 5,040,738 | 8/1991 | Biagiotti | 242/66 |
| 5,104,055 | 4/1992 | Buxton | 242/56 R X |
| 5,137,225 | 8/1992 | Biagiotti | 242/56 R X |
| 5,150,848 | 9/1992 | Consani | 242/56 R |

FOREIGN PATENT DOCUMENTS

| | | | |
|---|---|---|---|
| 698907 | 12/1964 | Canada | 242/56 R |

*Primary Examiner*—Daniel P. Stodola
*Assistant Examiner*—John P. Darling
*Attorney, Agent, or Firm*—Faegre & Benson

[57] ABSTRACT

A twin station rewinder having a transfer roll and a pair of rewinding rolls alternately rewinds a succession of paper logs at a pair of rewinding stations from a continuously advancing web of paper. The logs are wound on cores supplied to the each rewinding station which are thereafter held by diameter control rolls which move away from their respective winding roll to control web tension and log diameter during the log building process. Built logs are successively received in one of two log deceleration receivers and delivered to a log discharge position where they are dumped to a log discharge conveyor. New cores are supplied by a core supply conveyor to one of two core holders, each of which is associated with one of the log deceleration receivers. Cores are transferred from the core holders to the rewinding stations by a pair of core insertion arms which are retractable to permit the log building process.

34 Claims, 10 Drawing Sheets

TWIN STATION REWINDER

BACKGROUND OF THE INVENTION

This invention relates to the field of paper converting, more particularly to rewinding a web of paper into paper "logs" which are preferably relatively small diameter rolls of paper typically wound on cardboard tubular cores and suitable for cutting into short axial segments resulting ultimately in consumer sized rolls of toilet paper or kitchen towels or the like.

As shown in FIG. 1 a typical prior art surface winding system 2 typically used a single winding station 4 which transferred a core at the beginning of building a log during the early stages of winding through a nip between two rolls into a position wherein the log is held between three rolls. In such systems the log was then passed through a second nip between two of the three rolls before completing the winding cycle. It has been found that transferring the log from a two roll to a three roll contact and then back to two a roll contact causes discontinuities in the winding process reflected in deficiencies in product quality in logs wound by such a process.

The present invention overcomes shortcomings of the prior art by having uninterrupted three roll contact throughout the winding cycle which has been found to substantially improve product quality in the log as it is wound from the core to the finished diameter.

DETAILED DESCRIPTION

Figure 1:
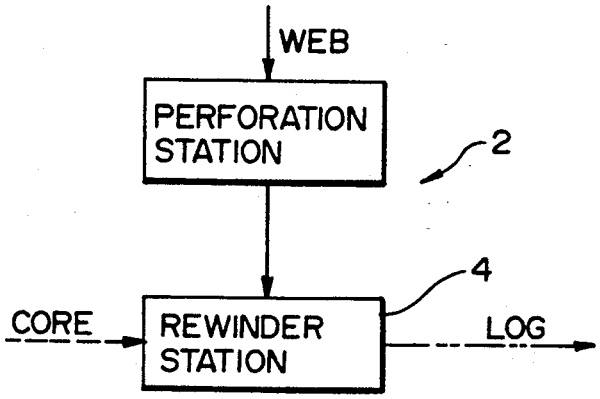
Fig. 1 PRIOR ART
FIG. 1 is a block diagram of a prior art surface winding system.
Figure 2:
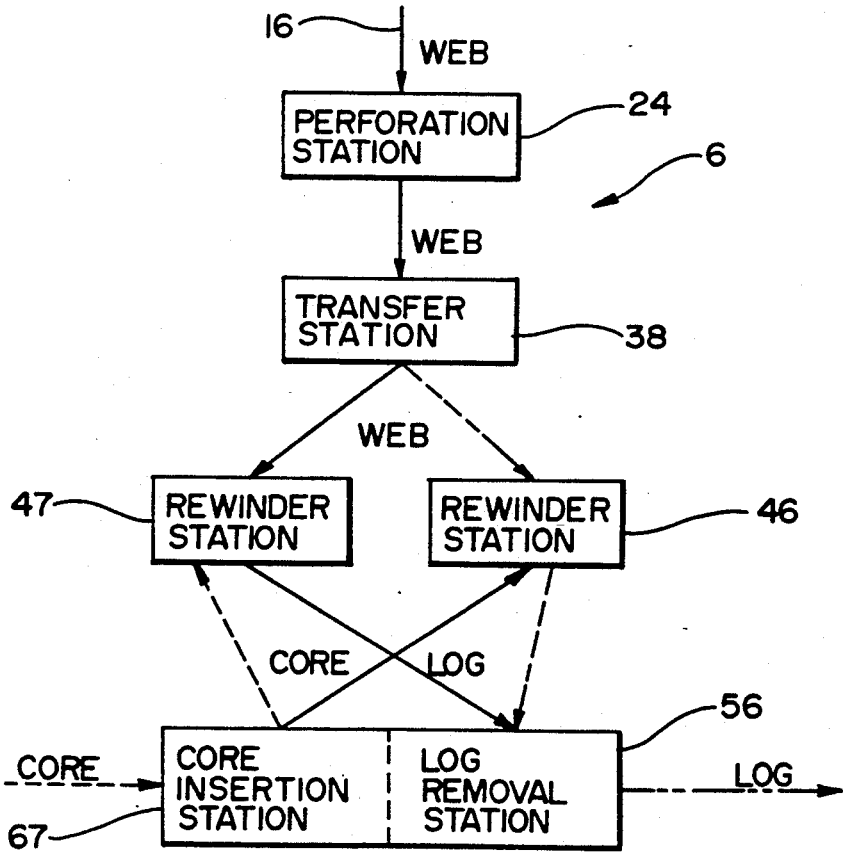
FIG. 2 is a block diagram of the twin station rewinder of the present invention.

Referring now to FIG. 2, a block diagram 6 of the present invention may be seen. In the practice of the present invention, a web 16 is perforated transversely at a perforation station 24 and then is directed to one of two rewinder stations 46, 47 by a transfer station 38. While one rewinder station (e.g. 47) is building a log, the other rewinder station (e.g. 46) is supplied with a new core by a core insertion station 67. When the log is completed at rewinder station 47, it is discharged via a log removal station 56. The process repeats alternatingly at the two rewinder stations.

Figure 3:
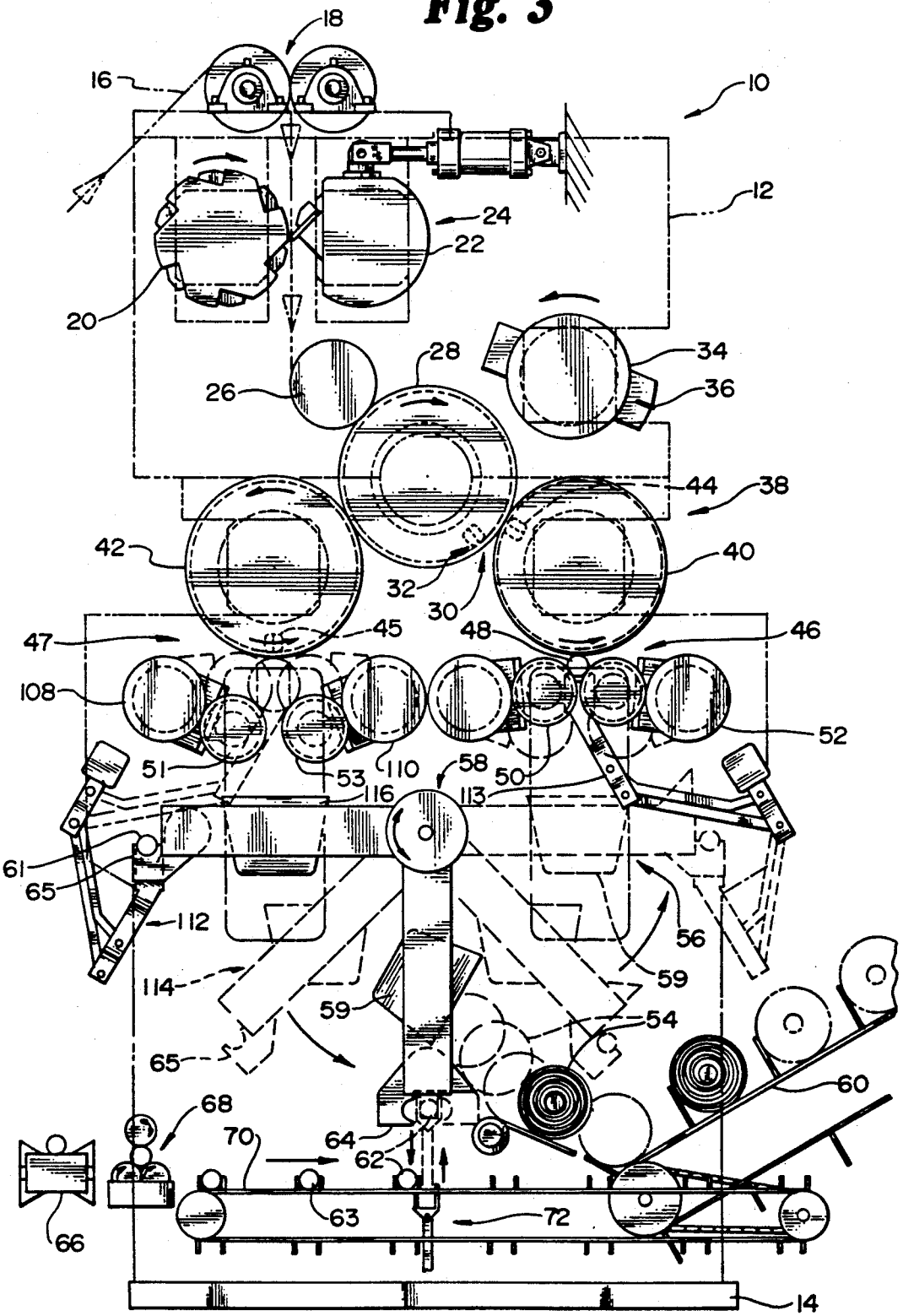
FIG. 3 is a simplified side view of the twin station rewinder embodiment of the present invention.

Referring now to FIG. 3, a twin station rewinder 10 of the present invention preferably has a pair of frames, one of which is shown in phantom by chain line 12, and preferably supported on a base 14.

A web 16 of paper advances through a predetermined path within frame 12 of rewinder 10. Web 16 passes through a pair of pull rolls 18 to control tension on web 16. Web 16 then passes through a pair of perforation rolls 20, 22 which together make up a perforation station 24 which provides a line of slits across the entire width of web 16. It is to be understood that web 16 may be as wide as 140 inches.

Web 16 then advances to and past an idler roll 26 to a transfer roll 28. Transfer roll 28 has a vacuum porting arrangement 30 and preferably includes a channel 32 which runs across the length of a face of roll 28. A chop roll 34 is positioned adjacent to and rotates in synchronism with transfer roll 28. Chop roll 34 preferably has a chop blade 36 which is selectively actuatable radially inward and outward with respect to roll 34. When blade 36 is actuated radially outward, chop roll 34 will rupture web 16 along a row of perforations by urging web 16 into channel 32 on roll 28. It is to be understood that chop roll blade 36 is actuated to rupture web 16 only at the completion of building of a log. At other times, chop roll 34 rotates with blade 36 radially retracted inwardly. Rolls 28 and 34 together with the upper portions of each of a pair of winding rolls 40, 42 make up a transfer station 38.

It is to be understood that the vacuum porting arrangement 30 on roll 28 preferably holds web 16 on each side of the channel 32 from a time before the chop roll blade 36 enters channel 32 until the severed edges of web 16 are transferred to one of the pair of winding rolls 40, 42. The winding roll receiving the leading edge of web 16 uses a vacuum port to remove web 16 from transfer roll 28 and hold the leading edge of web 16 against itself. For example, winding roll 40 uses port 44 to hold and advance the web to a rewinding station 46 where web 16 contacts a core 48, preferably carrying circumferential glue strips (applied by a glue station 68). Web 16 then begins to wind on core 48. Core 48 is cradled between a pair of diameter control rolls 50, 52 and is held against the corresponding or associated winding roll 40. Diameter control rolls 50, 52 move away from winding roll 40 in a controlled manner while maintaining contact, thus allowing building of a log of paper on core 48, while the paper log increases in diameter. It is to be understood that the first rewinding station 46 is made up of the lower portion of winding roll 40 positioned downstream of transfer roll 28. The second rewinding station 47 is similarly made up from rolls 42, 51 and 53. Once the paper log reaches a desired final diameter it is completed; it is then released by diameter control rolls 50, 52 to a log removal station 56 where the log is received in a receiver 59 of a separator mechanism 58 (shown in phantom in FIG. 3. Mechanism 58 then moves to the position shown in solid lines in FIG. 3 where a completed log 54 is discharged from receiver 59 to a log discharge conveyor 60. As log 54 is discharged from mechanism 58 to conveyor 60, a new core 62 is delivered to a carrier or holder 64 associated with receiver 59 of mechanism 58. Mechanism 58 makes up log removal station 56 conveyors 66 and 70, core loader 72, core holders 64, 65 and core insertion means 112, 113 make up a core insertion station 67.

It is to be understood that cores are preferably supplied by a core infeed conveyor 66, while glue may be applied at a glue station 68 with cores then being transferred to a core supply conveyor 70 which has a core loader 72 associated therewith, selectively actuatable to deliver a new core 62 to carrier 64 as a completed log 54 is delivered to the log discharge conveyor 60.

It is to be understood that rewinder 10 runs continuously with logs alternately wound and discharged at first and second rewinding stations 46, 47. Each of the rewinding stations 46, 47 has a pair of diameter control rolls downstream of and associated with a respective one of the winding rolls 40, 42. Having two rewinding stations permits a log to be wound at one station while the other station discharges a completed log and receives a new core for winding a subsequent log. The web 16 is alternated between winding stations 46 and 47 at the completion of each log, providing a smooth, controlled, adjustable transition from one log to the next, with consistent web tension throughout the winding cycle and without stopping the web.

At each winding station (46 for example) the log is wound from start to finish in a cradle formed by the diameter control rolls (50, 52 for example) below the log and by the winding roll (40, for example) above the log. The diameter control rolls (50, 52) under the log are preferably provided with a higher friction surface than that on the winding roll (40). The diameter control rolls consequently have far more control over the winding process than the single smooth-surfaced winding roll (40) located above the log. Adjusting the relative speed and position of the diameter control rolls with respect to the winding roll provides control of web tension at the log. By holding the log in the three-roll cradle from start to finish of winding, and by controlling web tension at the log, the log will be wound evenly from the core outward under adjustable, controllable conditions.

Figure 5:
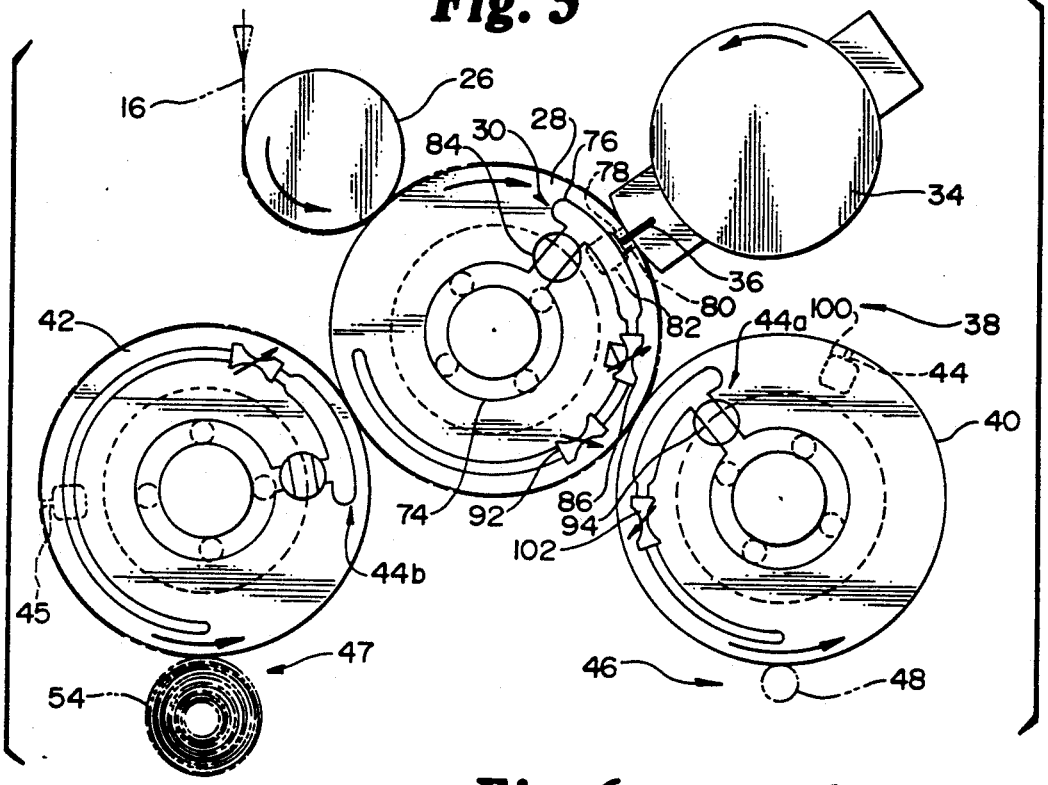
FIG. 5 is a schematic view of the transfer station and portions of the rewinding stations of the present invention showing various details of the vacuum arrangement for these stations.

Referring now to FIGS. 5–8, and most particularly to FIG. 5, various details of the vacuum porting arrangement 30 on transfer roll 28 and the vacuum porting **44*a* and 44*b* on winding rolls 40, 42** may be seen.

Figure 4:
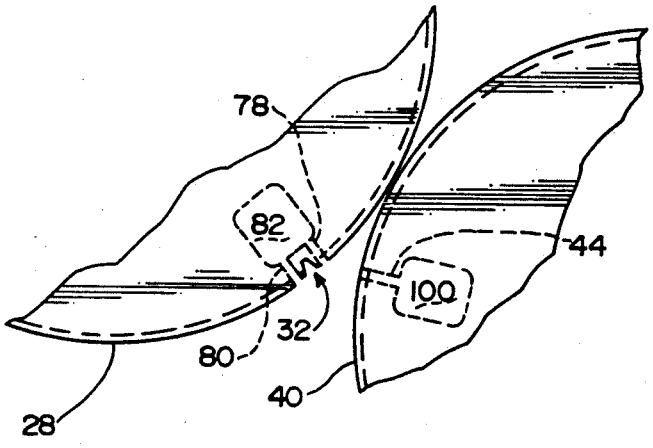
FIG. 4 is an enlarged fragmentary view of portions of the transfer roll and one rewinding roll showing details of the vacuum arrangements in the rolls.

It is to be understood that each of transfer roll 28 and winding rolls 40, 42 have vacuum control systems. These systems are used to control web 16 only during web severing and transfer of the severed web from roll 28 to one of rolls 40, 42. During the remainder of the winding cycle, the vacuum systems **30, 44*a*, 44*b* are shut off. Rolls 28, 40 and 42 are to be understood to be hollow tubular structures with attached journals. The hollow center of the rolls are connected to a vacuum pump and are used as reservoirs for the vacuum. Vacuum valves are mounted in a stationary manner at the end of the rolls. The vacuum valves have grooves cut in one face which are in contact with the end of the rolls. An inner circular groove 74 is concentric with the roll center. An outer circular groove 76 is in communication with the roll vacuum ports 78, 80 during the portion of rotation of the roll when the roll manifold 82 is in contact with the outer groove 76. For vacuum to exist at the vacuum ports 78, 80, the roll manifold 82 must be in communication with the outer groove 76 and a ball valve 84 between the inner groove 74 and the outer groove 76 must be open. A solenoid-operated flow control valve 86 is located in the outer groove 76 of the transfer roll vacuum valve. Before transfer of web 16 to the first winding roll 40 the flow control valve 86 is actuated to restrict the flow which reduces the vacuum level in manifold 82 as it passes flow control 86. This lower vacuum level assists in transferring the leading edge of web 16 to the first winding roll 40. Before transferring to the second winding roll 42 the flow control valve 86 is deactuated which removes the restriction from the outer groove 76. A manually adjusted flow control valve 92 located in groove 76 restricts flow to reduce the vacuum level in manifold 82 during transfer to the second winding roll 42. Valve 92 is used in the transfer to roll 42 because the tail of web 16 leaves ports 80 open (or uncovered) after manifold 82 passes the nip between rolls 28 and 40. FIG. 4 illustrates certain vacuum system details of rolls 28 and 40**. The vacuum valves adjacent roll ends have been omitted for clarity in this view.

Figure 6:
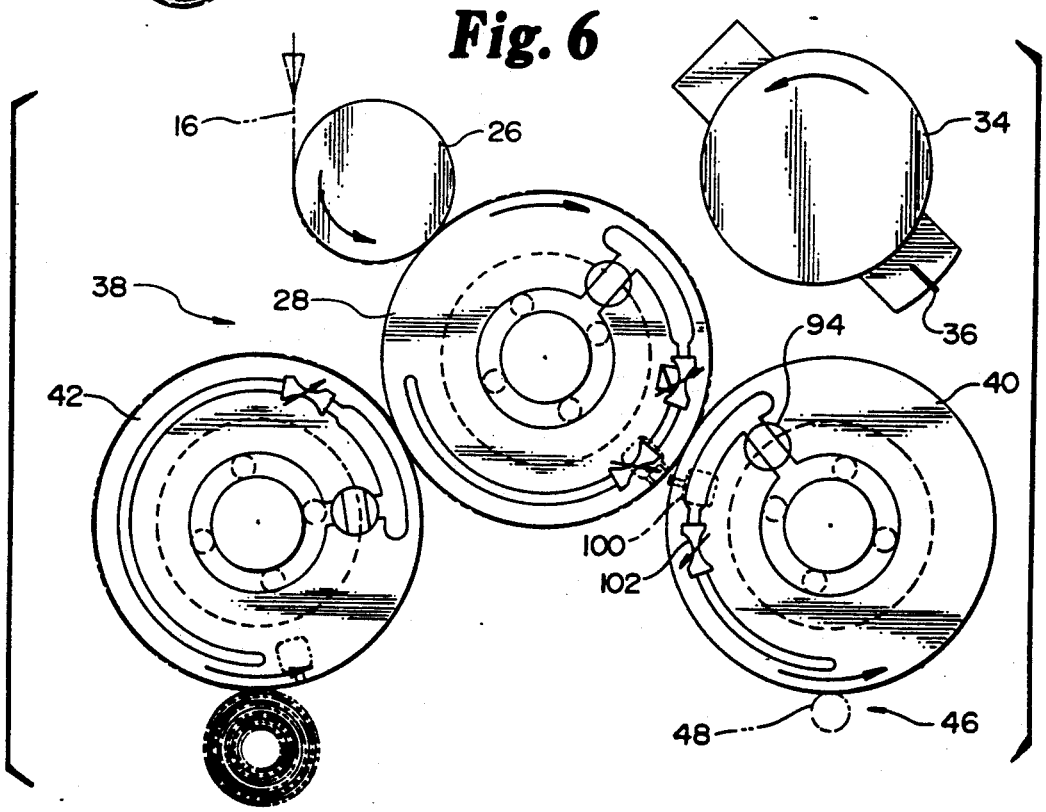
FIG. 6 is a view similar to FIG. 5 with the rolls advanced in a transfer cycle.
Figure 7:
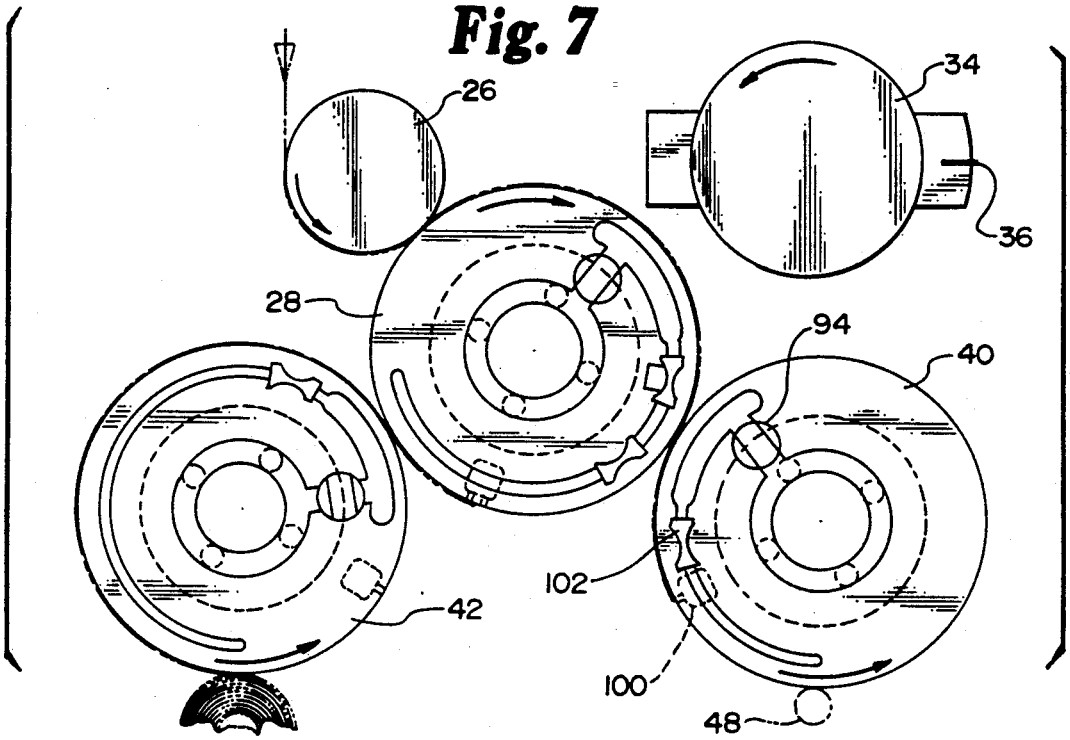
FIG. 7 is a view similar to FIG. 5 with the rolls still further advanced in the transfer cycle to one winding roll.
Figure 8:
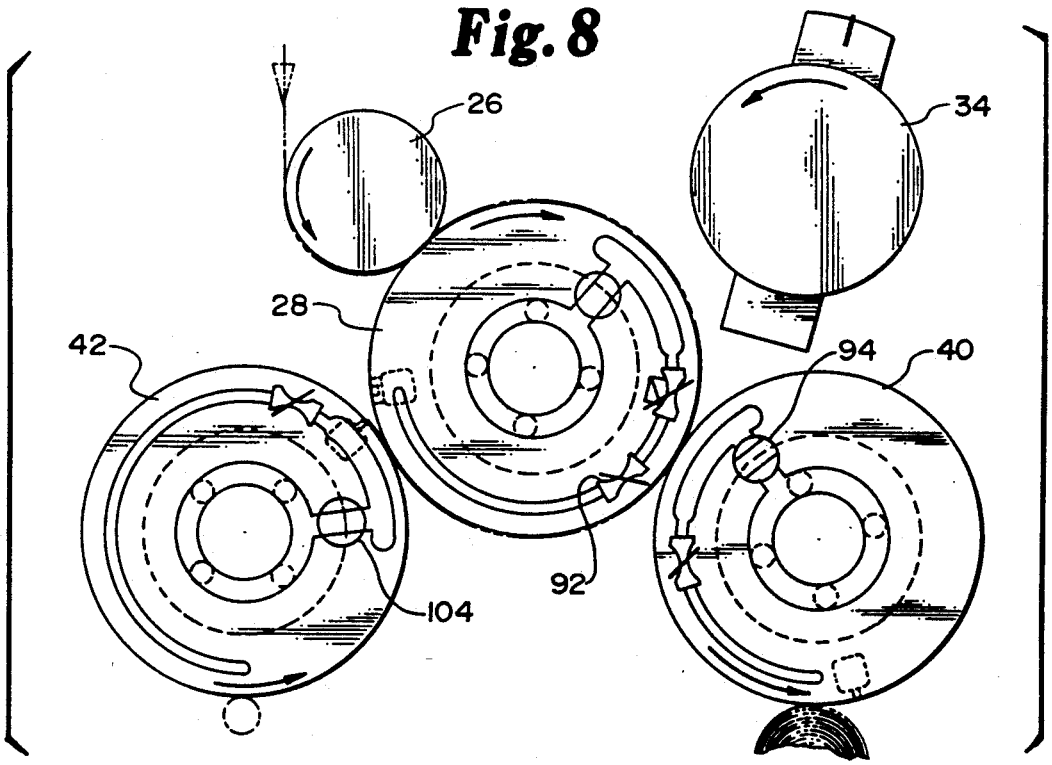
FIG. 8 is a view similar to FIG. 6 except showing a transfer to the other winding roll.

Referring now more particularly to FIGS. 5 and 6, to perform a transfer from winding a log 54 at the second rewinding station 47 to winding a log at the first rewinding station 46, the flow control valve 86 must be actuated. Chop roll blade 36 is extended during the last rotation of chop roll 34 to sever web 16 in channel 32. Ball valve 84 in roll 28 and ball valve 94 in roll 40 are opened. Vacuum is thus turned on at transfer roll 28 as the transfer roll manifold 82 reaches the outer groove 76 as would be the condition just prior to that shown in FIG. 5. Referring now also to FIG. 4, it is to be understood that transfer roll 28 has two rows of vacuum ports 78, 80, with one row on each side of channel 32. As channel 32 passes through the nip between the transfer roll 28 and chop roll 34, blade 36 ruptures web 16 as shown on FIG. 5. Transfer roll manifold 82 then passes flow control 86 and reduces vacuum at the transfer row vacuum ports 78, 80. The transfer roll vacuum ports 78, 80 pass through the nip between the transfer roll 28 and the first winding roll 40, carrying leading and trailing edges of the severed web 16. At this time, a row of vacuum ports 44 on first winding roll 40 contact and retain web 16 at the nip between transfer roll 28 and first winding roll 40. It is to be understood that the timing of vacuum to manifold 82 is preferably adjustable as a function of angular position of manifold 82. When it is desired to transfer the leading edge of web 16, vacuum reduced in roll 28 while full vacuum is maintained in roll 40. Subsequently, manifold 100 passes flow control 102 in roll 40. This reduces the level of vacuum in roll 40 holding web 16. A core 48 at first rewinding station 46 contacts the leading edge of web 16 and starts the next log as will occur just subsequent to the condition shown in FIG. 7. The chop roll blade 36 is retracted radially towards the center of roll 34 and the vacuum ball valve 94 is closed until the next transfer to roll 40. As may be seen in FIG. 8, transferring web 16 to the second winding roll 42 is similar to the process described for transferring to roll 40 except that valve 86 is held wide open and valve 92 is used to modulate vacuum in that portion of roll 28 between rolls 40 and 42 while Ball valve 104 in roll 42 is opened and ball valve 94 in roll 40 is held closed. Valve 92 is adjusted to a vacuum level appropriate to hold the leading edge of web 16 to roll 28 after the tail of the preceding portion of web 16 has left roll 28, uncovering ports 80 as manifold 82 traverses the region between rolls 40 and 42.

Figure 9:
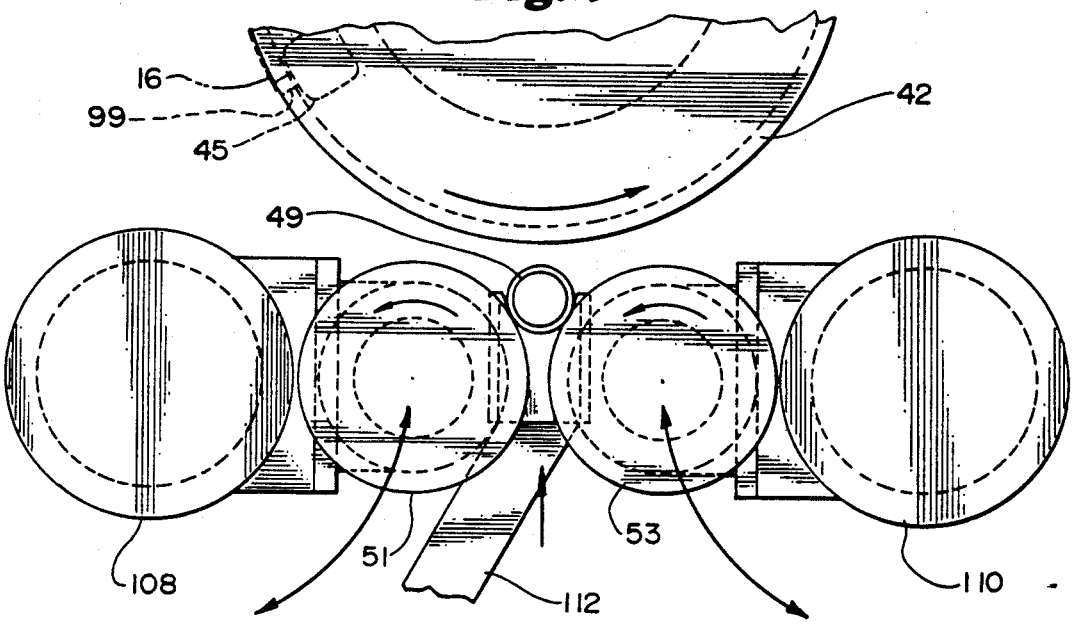
FIG. 9 is a detailed view of a winding station and a portion of a core insert mechanism inserting a new core between a winding roll and a pair of diameter control rolls.

Referring now to FIGS. 3 and 9–12, and most particularly to FIG. 9, core insertion, winding control, and log removal will be described. Rewinder 10 has two rewinding stations 46, 47. First winding station 46 includes winding roll 40 and two diameter control rolls 50, 52. Second winding station 47 includes second winding roll 42 and has a pair of diameter control rolls 51, 53.

Referring now most particularly to FIG. 9, diameter control rolls 51, 53 are each preferably mounted on respective pivot mechanisms 108, 110 located below winding roll 42. Mechanisms 108, 110 allow their respective diameter control rolls to move away from winding roll 42 as a log 54 built on core 49 increases in diameter (see FIG. 11). Each rewinding station has a core insert mechanism 112 to position and hold the core between the diameter control rolls prior to the start of a winding cycle.

Figure 12:
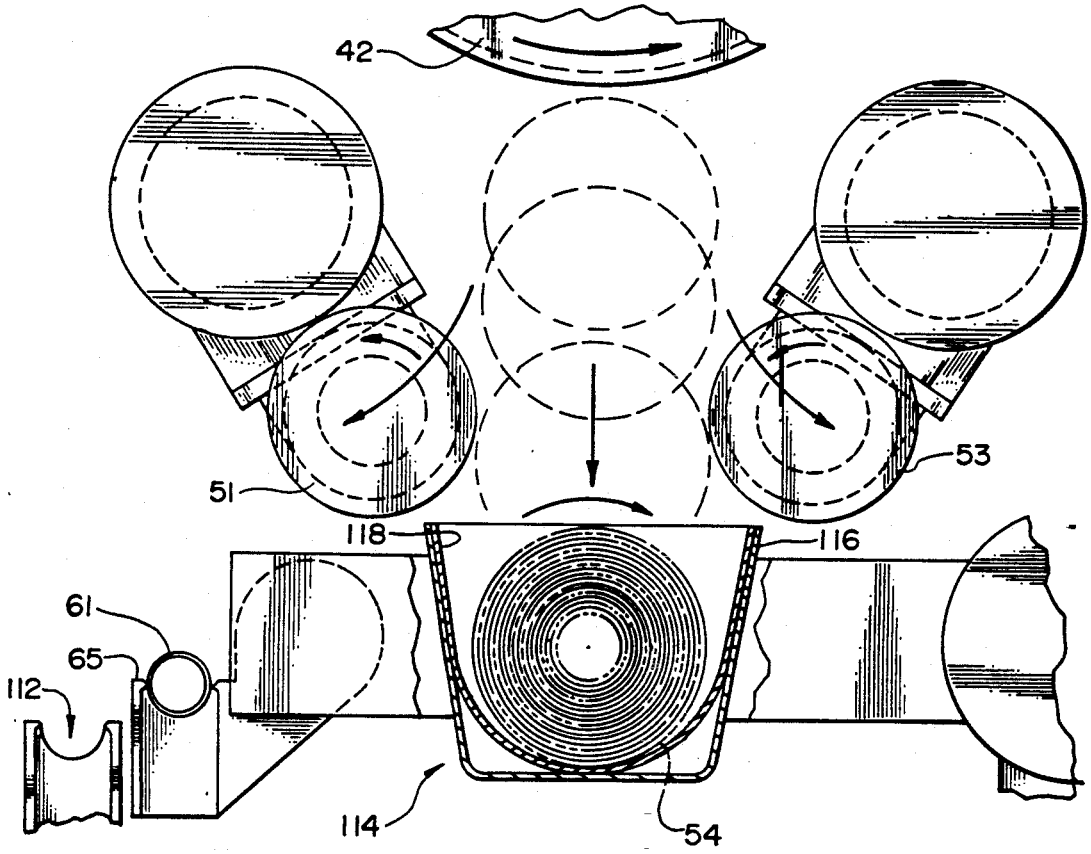
FIG. 12 is a view similar to FIG. 11, except after the log is released from the winding station and received by a log deceleration receiver at the log removal station.
Figure 11:
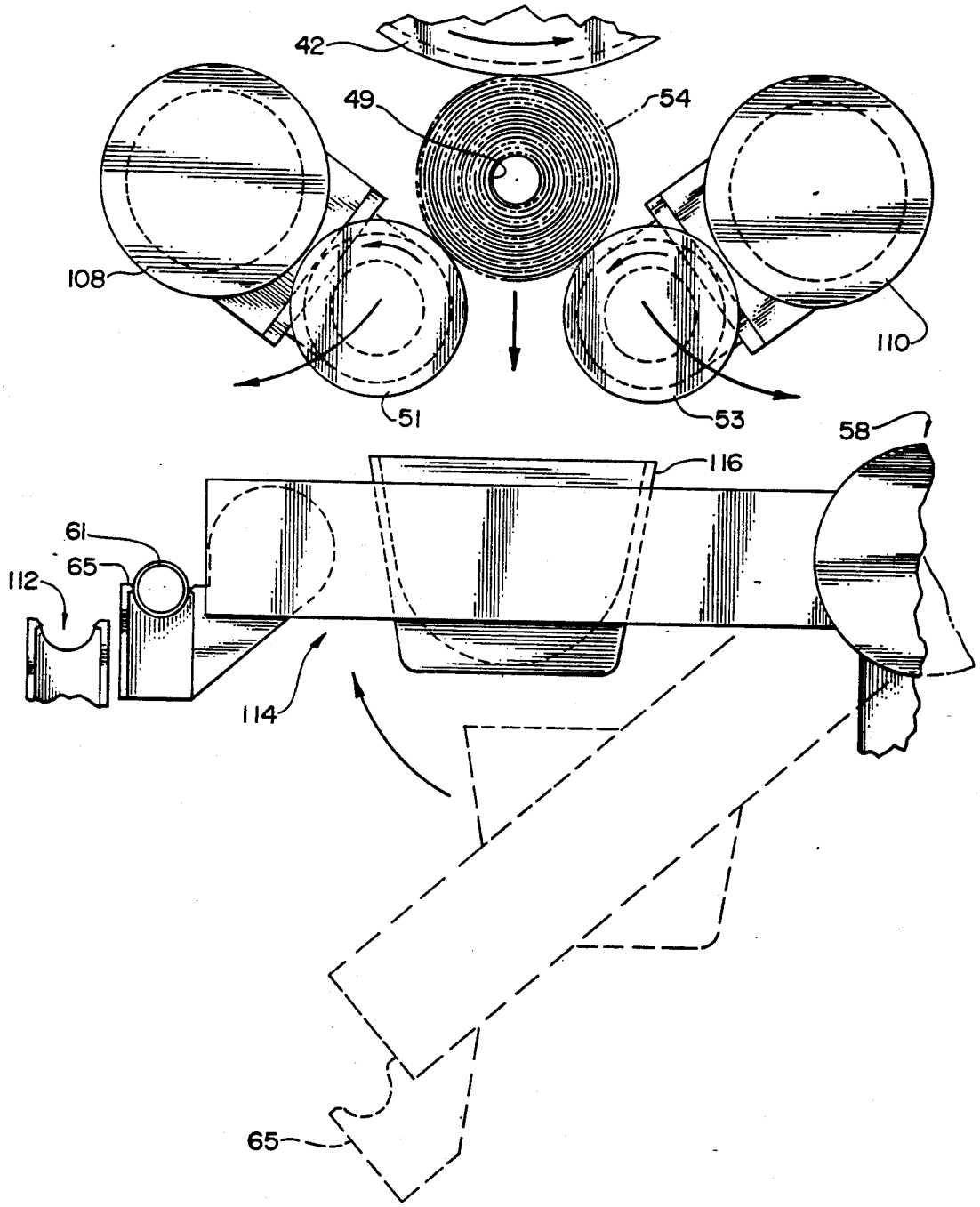
FIG. 11 shows a view similar to FIG. 9, except with a completed log immediately prior to release from the winding station to a log removal station.

Referring now also to FIG. 11, each rewinding station has a log removal means 114 including a log deceleration receiver 116 which is positioned below the diameter control rolls to receive a built log as indicated in FIG. 12.

It is to be understood that web 16 is alternated between rewinding stations 46 and 47 by transfer roll 28. The operating cycle at a particular rewinding station is divided between winding during one-half of a cycle and log removal and core insertion during the other half of the cycle.

Figure 10:
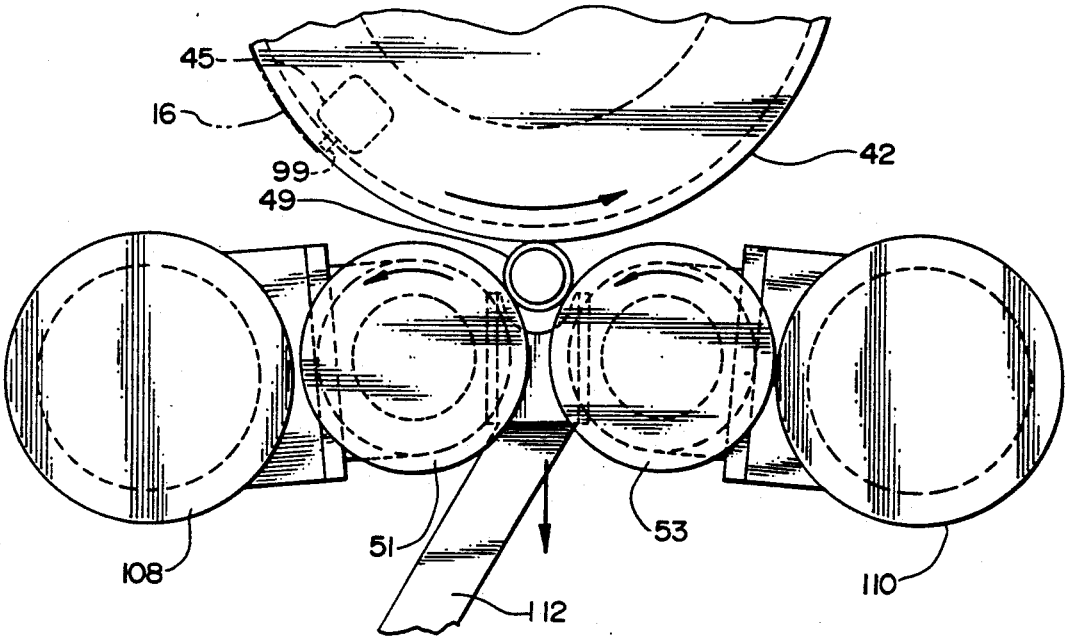
FIG. 10 shows a view similar to FIG. 9, except with the diameter control rolls supporting the core against the winding roll in a three point contact.

Prior to the winding portion of a log building cycle, the core insertion means 112 positions a core 49 approximately one-half inch below the winding roll 42. It is to be understood that the core insert mechanism 112 is in reality a plurality of a number of core holders mounted on four-part linkages. The core holders grip the core mechanically or by vacuum and are connected by a common shaft to make them work in unison to position a core as desired. The plurality of linkages are necessary because of the length of the core. As shown in FIG. 10, diameter control rolls 51, 53 move up quickly and lift core 49 from mechanism 112, trapping core 49 between rolls 42, 51 and 53 at which time core 49 is accelerated to the surface speed of the rolls. To assure that core 49 is in contact with winding roll 42 over its full length when web 16 arrives, core 49 is preferably squeezed or urged against winding roll 42 by diameter control rolls 51, 53. It is further to be understood that core 49 preferably has circumferential rings of glue on it at this time to bond with the leading edge of web 16. It is also to be understood that winding rolls 40, 42 and diameter control rolls 50, 52 and 51, 53 have corresponding grooves to prevent contact with the glue rings on cores 48 and 49. It has been found preferable to minimize the time between lifting a core from the core inserter and arrival of web 16 to reduce the opportunity for glue to contact any of rolls 40, 42, 50, 51, 52 or 53.

The winding cycle to build a log begins as web 16 is transferred to the winding roll 42 from transfer roll 28. Vacuum port 99 carries the leading edge of web 16 to core 49. As has been previously described, vacuum in winding roll 42 is throttled to a relatively low level by the time the web reaches the core. As soon as web 16 begins to wind on core 49, diameter control rolls 51, 53 begin to move away from roll 42 to relieve the core squeeze and to begin building along a curve which keeps a desired pressure on the building log. One technique to control rolls 51, 53 is to calculate the appropriate position of rolls 51, 53 at a plurality of diameters of a log while it is building from a core to a desired finished diameter. Each calculated position is a function of the linear length of web 16 accumulated up to that point. Rolls 51, 53 may be moved step-wise between such calculated points or positions and such movement will approach a continuous smooth curve as more and more points are calculated and used in this curve-fitting technique. It is to be understood, however, that the determining factor in the number and incremental spacing of the points is the finished log quality and hence the "best" step-wise approximation may not correspond to the best fit to the theoretical mathematical curve (as would be indicated by a least-squares or other mathematical error measurement).

At the end of the winding cycle at one rewinding station, the web is transferred to the other rewinding station (as has been previously described) and the diameter control rolls 51, 53 open quickly (as shown in FIG. 11 and 12) to drop a built log 54 into the log deceleration receiver 116. Receiver 116 preferably has a smooth inner surface 118 to contain log 54 without damaging it as it decelerates. Mechanism 114 is then lowered to allow core inserter 112 to pickup a new core 61 from a core holder or carrier 65. It is to be understood that the release of a built log and an insertion of a new core is the same for rewinding station 46 as it is for rewinding station 47, as is illustrated in FIGS. 9–12.

Figure 13:
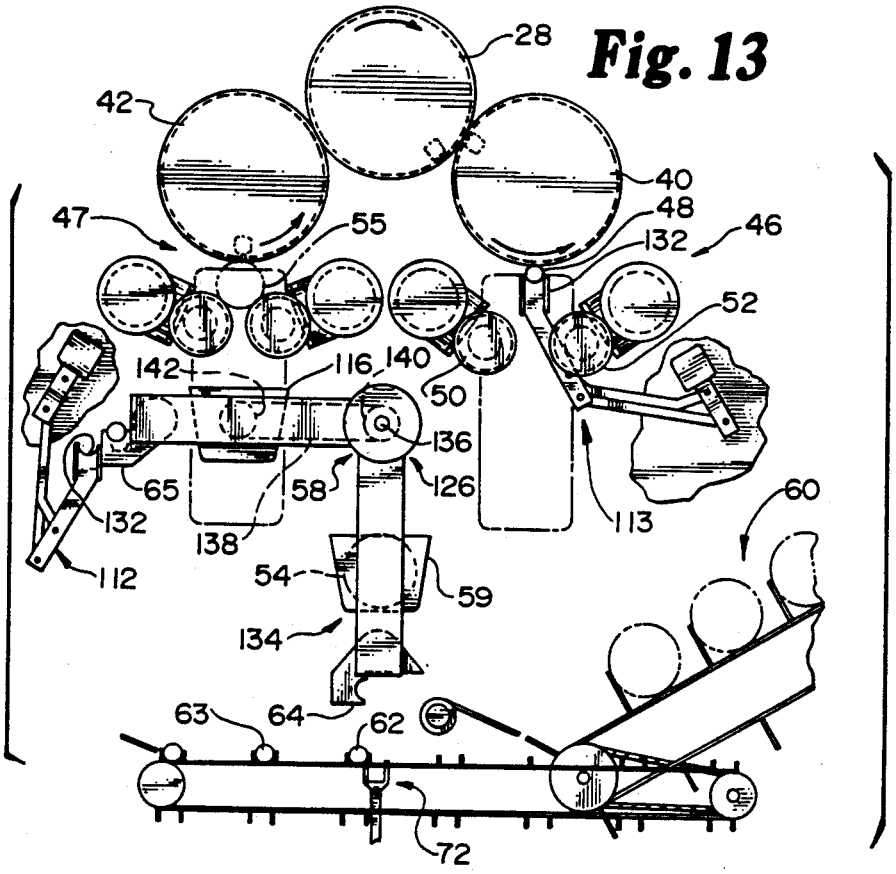
FIG. 13 is a view of the transfer station, rewinding stations, and log removal station, along with a core supply conveyor and log removal conveyor with a new core being positioned for initiation of winding at the first winding station and a log being wound at the second winding station. A completed log is retained in a log deceleration receiver prior to delivery to the log discharge conveyor and a new core are positioned on the core supply conveyor for delivery to a core holder on the log deceleration receiver mechanism.

Referring now to FIGS. 13–17, and most particularly to FIG. 13, operation of the log removal station 56 will be described in more detail. It is to be understood that the log removal station 56 cooperates and is partially integrated with apparatus of core insertion station 67 and utilizes a separator mechanism 58 to deliver cores to and remove logs from the first and second rewinding stations 46, 47. Separator 58 includes core carriers or holders 64, 65 as well as log deceleration receivers 59, 116. Station 67 also includes the core insert mechanisms 112, 113 which are preferably independent of each other. They each include a core holder or inserter 132 mounted on a four-bar linkage. Core inserter 132 preferably holds a core by mechanical grippers or vacuum, as desired.

Figure 17:
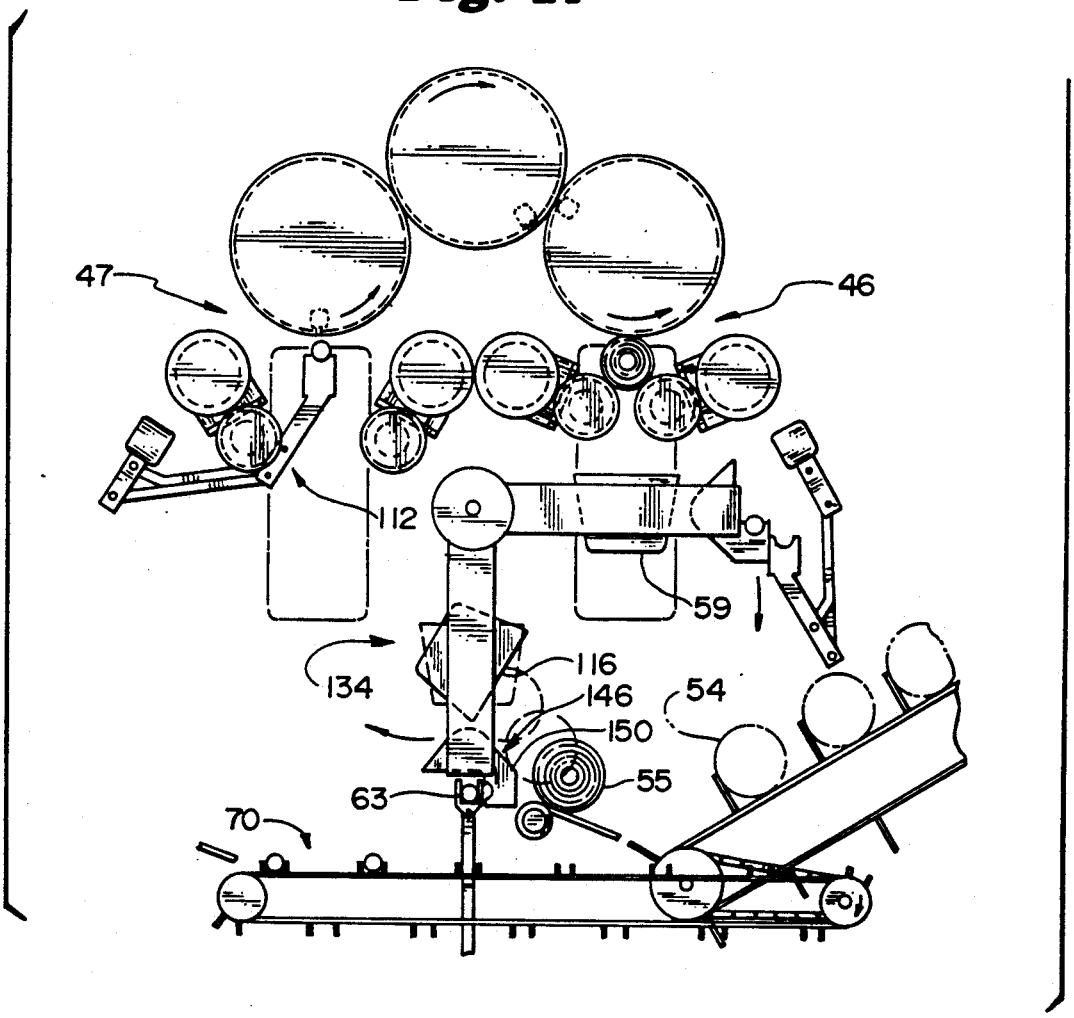
FIG. 17 is a view similar to FIG. 13 except with the log removal and core insert mechanism still further advanced in the cycle such that the log removal and core insert mechanisms are positioned with respect to the first winding station similar to the way they were positioned with respect to the second winding station in FIG. 13.

Turning now to mechanism 58, each log deceleration receiver is designed to contain and control a log as it enters the receiver at a high rotational speed. Mechanism 58 controls the motion of receivers or containers 59, 116 as the logs from the first and second rewinding stations 46, 47 are delivered and discharged at a common point 134 to log discharge conveyor 60. Linkage 58 is preferably an "L" shaped bar 126 carrying receivers 59, 116. It is to be understood that bar 126 pivots about the intersection 136 of the proximate ends of the two arms of the "L". This motion positions receiver 59 at the first winding station 46 while receiver 116 is at the discharge location 134 as shown in FIG. 17. Alternately, linkage bar 126 positions receiver 116 at the second rewinding station 47 while receiver 59 is at the discharge location 134 (as shown in FIG. 15). Core holders 64, 65 are preferably mounted on the distal ends of the two arms of bar 126. A new core is preferably loaded into the holder at the log discharge location or dump point 134 as indicated in FIGS. 14 and 17.

Figure 16:
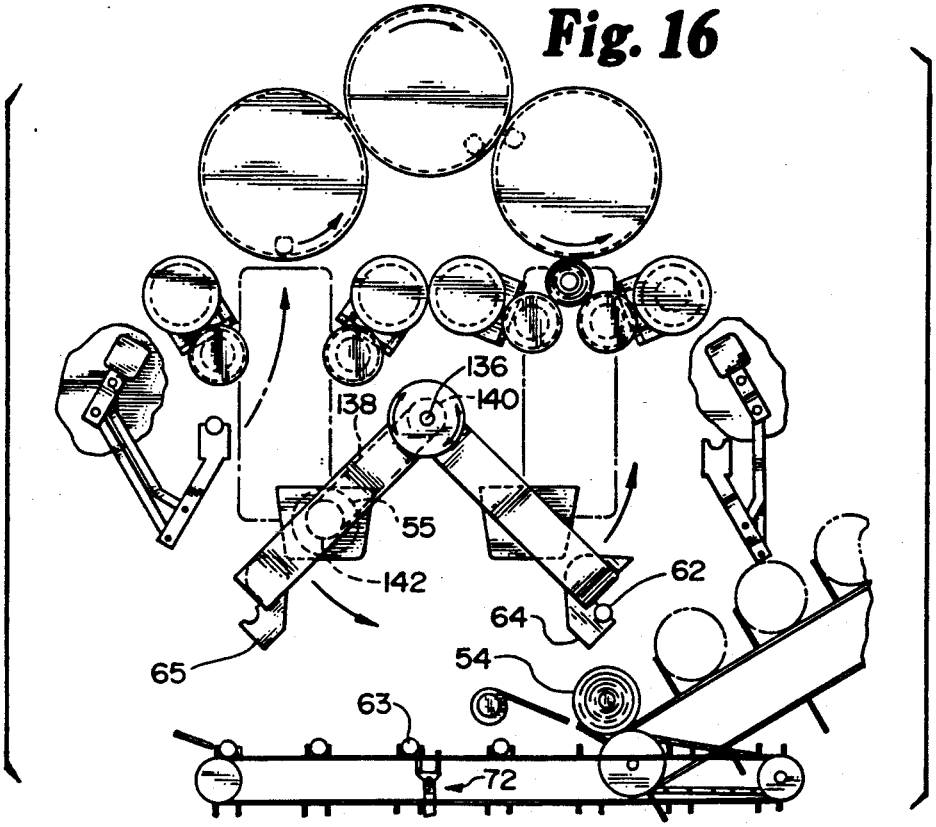
FIG. 16 is a view similar to FIG. 13 except with the log removal and core insert mechanism still further advanced in the cycle.

Receivers 59, 116 are preferably held horizontal except when discharging a log at dump point 134. One means of holding the receivers horizontal is to use a timing belt 138 between a non-rotating sprocket 140 at pivot 136 and a rotatable sprocket 142 associated with receiver 116. When bar 126 pivots about point 136, belt 138 will hold receiver 116 horizontal as illustrated in FIGS. 13 and 16. When it is desired to discharge a log (as shown in FIG. 17) an air cylinder (not shown) or other suitable actuator connected between sprocket 142 and receiver 116 rotates receiver 116 with respect to sprocket 142 to the position shown in FIG. 17. It is to be understood that a corresponding leveling arrangement is preferably provided for receiver 59.

A full separator cycle delivers two logs to the dump point 134 and inserts two cores, one to each winding station. As shown in FIG. 13, the diameter control rolls 50, 52 are open and a core is located on inserter 132 at the first rewinding station. Retainer has carried a log 54 wound at the first rewinding station 46 to the dump point 134 while at the second rewinding station 47, a log is partially wound. Retainer 116 is positioned with a new core 61 below diameter control rolls 51, 53 at this time. It may be noted that core inserter 112 is fully retracted as well.

Figure 14:
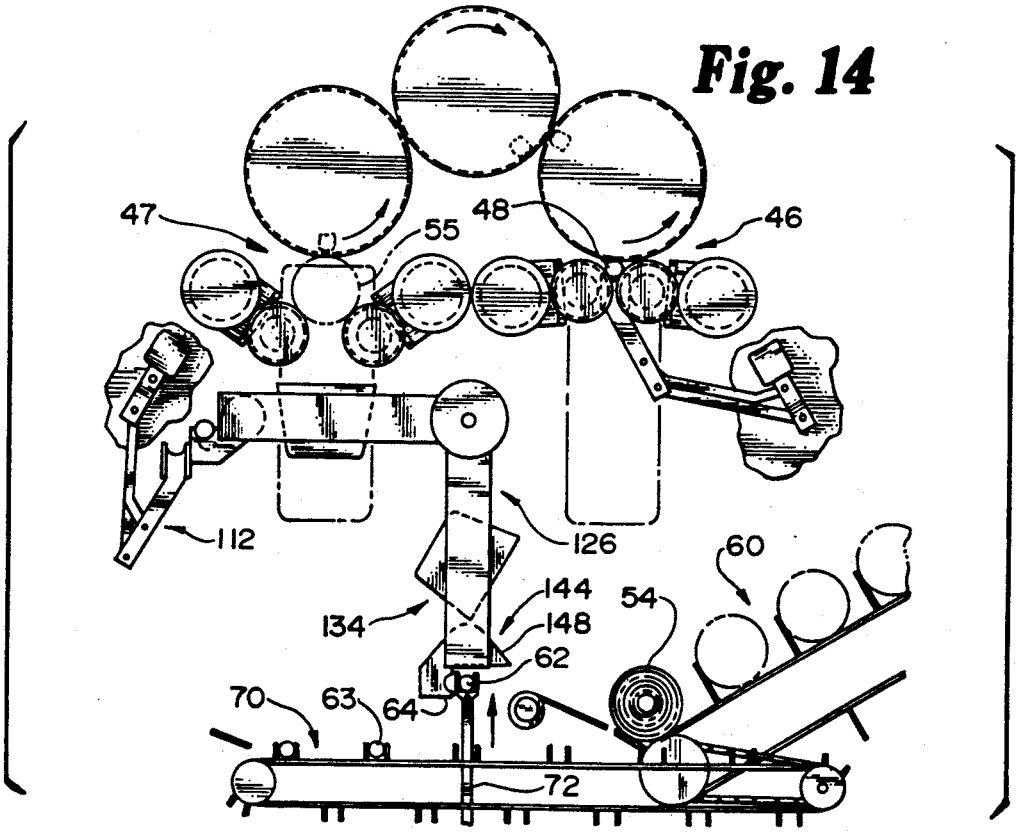
FIG. 14 is a view similar to FIG. 13 except with the log removal means advanced in the cycle to discharge a completed log to the log discharge conveyor and to accept a new core from the core supply conveyor.
Figure 15:
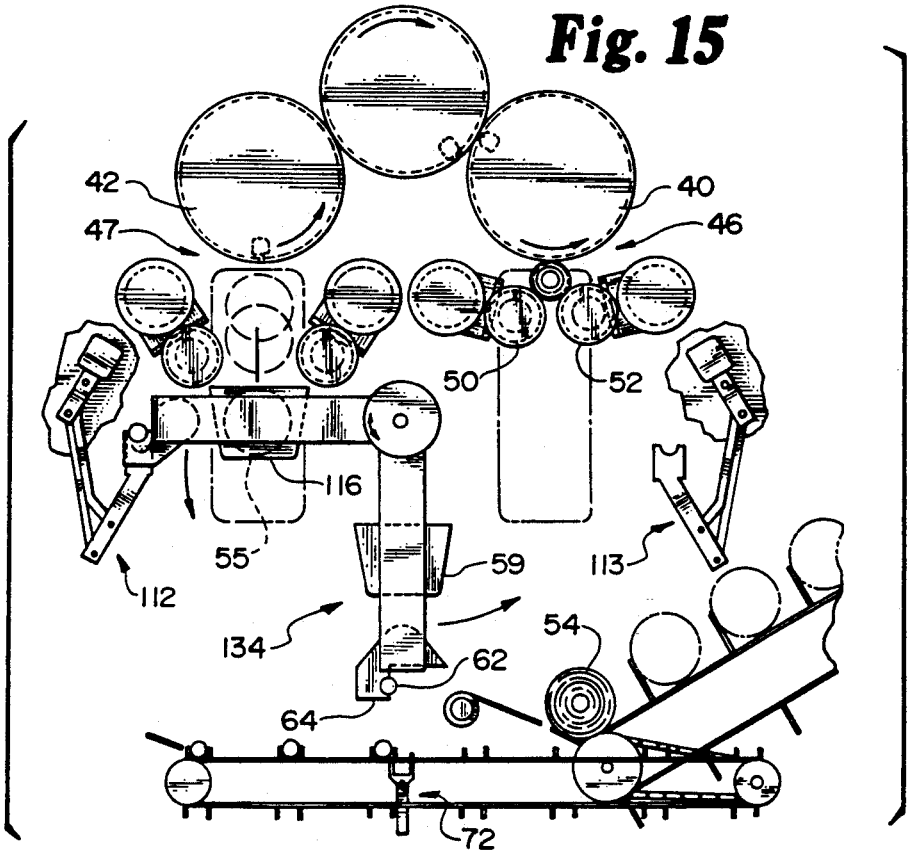
FIG. 15 is a view similar to FIG. 13 except with the log removal and core insert mechanism further advanced in the cycle where a completed log is delivered from the second winding station to a log deceleration receiver and a core is being picked up by the associated core insert mechanism from the core holder adjacent that receiver.

Referring now to FIG. 14, diameter control rolls 50, 52 lift core 48 off inserter 132 and squeeze core 48 against winding roll 40. Log 54 is dumped at dump point 134 and a new core 62 is loaded into holder by core loader 72. FIG. 14 shows a log 55 completely built at the second winding station 47 at which time web 16 is transferred to the first rewinding station 46 in a manner previously described. Referring now also to FIG. 17, each core holder 64, 65 may include respective guide means 144, 146 for guiding a log discharged from its associated receiver to the log discharge conveyor. Guide means 144, 146 are preferably inclined surfaces 148, 150.

Referring now to FIG. 15, a log is partially wound at the first rewinding station 46 and core insert mechanism 113 is fully retracted. Simultaneously diameter control rolls 51 and 53 pivot away from winding roll 42 permitting the log at the second rewinding station 47 to be discharged to receiver 117. Core insert mechanism 112 is simultaneously moved such that core inserter 112 picks up a new core from support 65 associated with receiver 116 and subsequently positions it for core insertion as indicated in FIGS. 16 and 17. It is to be understood that each core insertion mechanism is extendable to a core insertion position (see, e.g., articulated core insertion arm 113 in FIG. 13) for inserting a core at the respective rewinding station 46. Each arm is also retractable to a clearance position (see, e.g., arm 112 in FIG. 13) to permit log removal mechanism 58 to reciprocate. Each arm is also positionable to a core transfer position (as illustrated) by arm 112 in FIG. 15) intermediate the core insertion and clearance positions. The core transfer position for arm 112 is adjacent its respective core holder 65 for transferring a core from holder 65 to arm 112. As may be seen in FIG. 15, the core insertion arms 112, 113 are preferably pivotably supported on the rewinder outboard of the rewinding stations 46, 47.

At the first rewinder station 46, as shown most clearly in FIG. 16, receiver or retainer 59 is moving into position under diameter control rolls 50, 52. At the second rewinder station 47, retainer 116 carrying completed log 55 moves toward dump point 134. It is further to be understood that the core infeed conveyor 66, glue station 68, core supply conveyor 70 and log discharge conveyor 60 all index to supply new cores as log deceleration and removal mechanism 58 operates.

In FIG. 17 a log is partially wound at first rewinding station 46. Retainer 59 carrying new core 62 is positioned under diameter control rolls 50, 52. At the second rewinding station 47, diameter control rolls 51, 53 are open and a core is positioned on holder 112 in the second rewinding station. The second half of the separator cycle is the same as the portion previously described, but at opposite winding stations. The separator mechanism is able to supply both rewinding stations from a common supply point (delivering cores 61, 62 63, etc. from conveyor 70). Cores are supplied to the separator mechanism 58 as logs are discharged from dump point 134. Such a combination allows a relatively high cycle rate for core insertion, log removal and rewinder operation.

The invention is not to be taken as limited to all of the details thereof as modifications and variations thereof may be made without departing from the spirit or scope of the invention.

What is claimed is:

1. A twin station rewinder for rewinding a web of paper into a plurality of logs comprising:

a) a transfer station comprising:

i) a single transfer roll for carrying a continuously travelling web, ii) an upper portion of first and second winding rolls adjacent to and downstream of the transfer roll and alternately receiving the web from the transfer roll, and iii) web severing means adjacent the transfer roll and upstream of the winding rolls for severing the web into segments in connection with a transfer from one winding roll to the other; and b) a pair of rewinding station means for rewinding the severed web segments comprising i) a lower portion of the first and second winding rolls, and ii) pivotable diameter control means located downstream of and associated with a respective one of the winding rolls, each diameter control means selectively pivotably positionable with respect to its respective winding roll for controlling the diameter of a log being built at that respective rewinding station.

2. The rewinder of claim 1 further comprising c) a core insertion station having:

core insertion means for inserting cores into either rewinding station in a three point nip formed by the respective winding roll and the associated first and second diameter control rolls in contact with the core at the respective rewinding station.

3. The rewinder of claim 2 wherein the core insertion station further comprises:

a pair of core holders for delivering cores to the core insertion means

4. The rewinder of claim 3 wherein the core insertion station further comprises:

a core supply conveyor, and core loader means for transferring cores from the core supply conveyor to the core holders.

5. The rewinder of claim 1 further comprising d) log removal means for removing a completed log from either rewinding station.

6. The rewinder of claim 5 wherein the log removal means comprises a reciprocable member for removing a completed log from one rewinding station and wherein the reciprocable member has core holder means for delivering a core to the other rewinding station.

7. The rewinder of claim 6 wherein the reciprocable member is reciprocable to remove a completed log from the other rewinding station and simultaneously deliver a core to the one rewinding station.

8. The rewinder of claim 6 further comprising core insertion means for inserting a core into each rewinding station, the core insertion means comprising a pair of core insertion arms, each associated with a respective rewinding station and i) movable to a core insertion position for inserting a core at the respective rewinding station, and ii) movable to a clearance position to permit reciprocation of the log removal means.

9. The rewinder of claim 8 wherein each core insertion arm is further:

iii) positionable to a core transfer position intermediate the core insertion and clearance positions, the core transfer position being adjacent the respective core holder for transferring a core from the holder to the insertion arm.

10. The rewinder of claim 9 wherein the core insertion arms are pivotably supported on the rewinder outboard of the rewinding stations.

11. The rewinder of claim 5 wherein the log removal means comprises a pivoting arm carrying a pair of log deceleration receivers.

12. The rewinder of claim 11 wherein the pivoting arm is pivoted intermediate the rewinding stations.

13. The rewinder of claim 11 wherein the pivoting arm is rotatable between:

i) a first position wherein one log deceleration receiver is located at a first log receiving position subjacent one of the rewinding stations and the other log deceleration receiver is located at a log discharge position, and ii) a second position wherein the one log deceleration receiver is located at the log discharge position and the other log deceleration receiver is located at a second log receiving position subjacent the other rewinding station.

14. The rewinder of claim 11 wherein each log deceleration receiver is pivoted on the pivoting arm.

15. The rewinder of claim 14 wherein each log deceleration receiver has a core holder associated therewith.

16. The rewinder of claim 15 wherein each core holder further comprises guide means for guiding a log discharged from the associated log deceleration receiver to a log discharge conveyor.

17. The rewinder of claim 16 wherein the guide means comprises an inclined surface for guiding a log from the associated receiver towards the log discharge conveyor when the guide means is at a log discharge position.

18. The rewinder of claim 1 wherein the web severing means comprises a chop roll.

19. The rewinder of claim 18 wherein the chop roll further comprises a selectively extendable radial blade for severing the web.

20. The rewinder of claim 1 wherein the diameter control means comprise a first and a second diameter control roll at each rewinding station.

21. The rewinder of claim 20 wherein the first and second diameter control rolls and the respective winding roll form a three point contact with the log being built at that respective rewinding station.

22. A method of rewinding a web into logs alternately formed at a pair of winding stations, each associated with one of a pair of winding rolls, the method comprising:

a) passing the web around a portion of a transfer roll and one of two winding rolls;

b) engaging the web with a core held in contact with that winding roll by diameter control means at one of the pair of winding stations;

c) pivotably moving the diameter control means away from that winding roll as the web builds a log on the core while maintaining contact between that winding roll and the log by urging the log against the winding roll with the diameter control means at the one winding station;

d) severing the web transversely upstream of the winding rolls when the log is built to a desired diameter;

e) transferring the leading edge of the severed web to the other winding roll at the other of the pair of winding stations by selectively applying vacuum in the transfer roll prior to a nip between the transfer roll and the other winding roll;

f) repeating steps b)–e) with the other winding roll while i) removing the log from contact with the one winding roll, ii) subsequently inserting a new core against the one winding roll; and g) repeating steps a)–f) to successively alternatingly insert cores and build and remove logs at each of the pair of winding stations without stopping the web at the transfer roll.

23. The method of claim 22 wherein step e) further comprises turning off vacuum in the winding roll finishing building a log.

24. The method of claim 22 wherein step e) further comprises reducing vacuum in the transfer roll in a region intermediate the winding rolls to assist in transfer of the web to the one winding roll when the web is to be transferred to that winding roll.

25. The method of claim 22 wherein step e) further comprises reducing vacuum in the winding roll after that winding roll receives the leading edge of the severed web to assist transfer of the leading edge to the core in contact with that winding roll.

26. The method of claim 22 wherein step d) further comprises turning on vacuum in the transfer roll prior to severing the web.

27. The method of claim 26 wherein step e) further comprises providing a reduced vacuum in the transfer roll upstream of a nip between the transfer roll and the one winding roll when the web is to be transferred to that winding roll.

28. The method of claim 22 wherein substep i) of step f) further comprises decelerating the log after removing the log from contact with the one winding roll.

29. The method of claim 28 wherein substep i) of step f) further comprises delivering the log to a log discharge conveyor.

30. The method of claim 22 wherein substep ii) of step f) further comprises receiving the new core from a core supply conveyor prior to inserting the new core against the one winding roll.

31. The method of claim 22 wherein step f) further comprises receiving the log from the one winding roll and decelerating the log in a log deceleration receiver while simultaneously picking up the new core from a core holder associated with the log deceleration receiver prior to inserting the new core against the one winding roll.

32. The method of claim 22 wherein the diameter control means comprise two pair of diameter control rolls, with one pair of diameter control rolls adjacent each winding roll.

33. A log discharge apparatus for discharging logs from a two station paper log rewinder without operator intervention, the apparatus comprising a rigid unitary arm having first and second ends and movable as a unit about a central axis to a first position wherein the first end is located at a first log receiving position while the second end is located at a log discharge position and wherein the arm is further movable as a unit to a second position wherein the first end is located at the log discharge position and the second end is located at a second log receiving position such that paper logs are alternately receivable at the first and second log receiving positions and dischargeable at a common log discharge position.

34. The apparatus of claim 33 wherein the arm is generally L-shaped.

* * * * *